United States Patent [19]

Dunning, Jr. et al.

[11] 4,242,192

[45] Dec. 30, 1980

[54] ELECTROLYTIC STRIPPING CELL

[75] Inventors: Beverly W. Dunning, Jr., Adelphi; D. Harry Chambers, Catonsville, both of Md.

[73] Assignee: The United States of America as represented by the Secretary of the Interior, Washington, D.C.

[21] Appl. No.: 72,956

[22] Filed: Sep. 6, 1979

[51] Int. Cl.[3] ..... C25C 1/20; C25C 7/00; C25C 7/02

[52] U.S. Cl. ..... 204/213; 204/212; 204/222; 204/273; 204/284

[58] Field of Search ..... 204/272, 212, 222, 273, 204/284

[56] References Cited

U.S. PATENT DOCUMENTS

| | | | |
|---|---|---|---|
| 4,000,056 | 12/1976 | Kelleher | 204/272 |
| 4,149,954 | 4/1979 | Ransbottom | 204/272 |
| 4,169,033 | 9/1979 | Dunagan | 204/272 X |

*Primary Examiner*—Arthur C. Prescott

*Attorney, Agent, or Firm*—William S. Brown; Donald A. Gardiner

[57] ABSTRACT

An electrolytic stripping cell is provided which is particularly adapted for use in processing shredded, silver brazed, stainless steel honeycomb scrap. The cell comprises a mesh anode basket which rotates within a cathode cylinder to provide partial stirring of the cell electrolyte. The anode basket includes a central hollow shaft having holes therein through which the electrolyte continually circulates. The basket includes wiper blades for dislodging silver dentrites which grow between the anode and cathode and which, as they fall, are collected in a mesh basket located at the bottom of the cell housing.

12 Claims, 2 Drawing Figures

ELECTROLYTIC STRIPPING CELL

FIELD OF THE INVENTION

The invention relates to electrolytic stripping cells and, more particularly, to an electrolytic stripping cell which is specifically adapted for processing shredded, silver brazed, stainless steel honeycomb scrap.

BACKGROUND OF THE INVENTION

Although not limited to such a use, the electrolytic stripping cell of the invention is, as stated, particularly adapted for use in processing silver brazed, stainless steel honeycomb scrap. Such scrap is commonly found in aircraft. For example, General Dynamics B-58, Lockheed C-141, and McDonnell F-4 aircraft contain honeycomb panels and sections which are to be removed and processed prior to processing the remainder of the airplanes for scrap.

It has been determined that silver braze can be electrolytically stripped from such shredded stainless steel honeycomb, and U.S. Patent Application Ser. No. 814,959, filed on July 12, 1977, now U.S. Pat. No. 4,090,935, granted May 23, 1978, discloses a suitable process. However, it has been found that commercially available stripping cells are not suitable for this purpose.

Well known commercial cells include the commercial Moebius type and Balbach-Thum cell systems. These cell systems are described for example in *Silver, Economics, Metallurgy and Use,* Butts and Coxe, D. Van Nostrand Company, Inc., Princeton, New Jersey 1967, p. 86. Both systems use a silver nitrate/copper nitrate electrolyte, a stainless steel or graphite cathode for deposition of the silver crystals, an impure Doré anode that assays between 94 to 99 percent silver, and wiper blades or scrapers to break off the silver dendrites and prevent electrical shorts between cathode and anode. The bulk density of the cast Doré anode would approximate 10.6 grams per cubic centimeter so the anode basket or compartment necessary to contain the Doré anode in these cells is relatively small.

Either of these commercial cell systems would have decided disadvantages in processing shredded, silver brazed, stainless steel honeycomb. For example, the small anode basket size presents problems. Specifically, the bulk density of the shredded, silver brazed, stainless steel honeycomb ranges between 0.4 to 0.8 grams per cubic centimeter compared to 10.6 grams per cubic centimeters for Doré anodes. A second related factor is the percentage of silver in the two anode charges. An anode charge of shredded, silver brazed, stainless steel honeycomb, such as being considered here, assays approximately 10 percent silver whereas the Doré anode is nominally 95 percent silver. These two factors, low bulk density and low silver content, require the anode basket to be the largest item, with regard to volume, in the cell for the cell to be practical commercially. Further, the lack of electrolyte circulation in the two commercial electrolytic cell systems is a decided disadvantage. In this regard, it has been determined in electrolytic stripping tests run for a reasonable length of time, and without rather vigorous electrolyte circulation, that silver recovery is less than 60 percent. In addition, chemical assays of the residual shredded stainless steel honeycomb removed from simulated Thum cell tests indicated that pieces of the outer skin detached from the honeycomb material by the shredding action was virtually free of silver; however, pieces of the cellular core structure still attached to outer pieces of skin contained recoverable amounts of silver. It will be appreciated that in a situation where each silver ion is made to travel a very complex and intricate path between the anode and cathode through a maze of inert baffling, agitation or stirring of the electrolyte is necessary even in commercial cells. Thus, when shredded, silver brazed, stainless steel honeycomb is used as the anode in an electrolytic silver refining cell, an analogous situation exists, i.e., a very complex path is provided, and commercial cells, which do not provide such stirring, have been found to be impractical.

Other prior art of possible interest includes U.S. Pat. Nos. 2,563,903 (Zadra); 3,715,229 (Anderson et al); 3,915,832 (Backus et al); and 3,985,634 (Larson et al).

SUMMARY OF THE INVENTION

In accordance with the invention, an electrolytic stripping cell is provided which overcomes the problems associated with the prior art and, among other advantages, enables processing, on a commercial scale, of shredded, silver brazed, stainless steel honeycomb scrap.

According to a preferred embodiment thereof, the invention comprises an electrolytic stripping cell for recovering silver and other metals from bulky low density scrap containing such metals, which cell comprises: a rotatable perforated basket for receiving charge of the scrap and constituting the anode of the cell; a sheet metal cylinder surrounding the basket and spaced therefrom; a housing in which the basket and the cylinder are contained; means for supplying an electrolyte to the cell; and means for rotating the anode basket to provide agitation of the electrolyte within the cell. For the specific use discussed above, the anode basket is designed to fill substantially the entire cell because of the low bulk density of the anode charge. Preferably, the means for circulating an electrolyte in the cell includes a central hollow shaft affixed to the rotatable basket and having a plurality of openings along the length thereof through which the electrolyte passes. Further, the means for rotating the basket preferably comprises drive means for rotating the shaft. Advantageously, the electrolyte circulating means further comprises a rotating seal mounted on the shaft for permitting electrolyte to be supplied to the shaft while the latter is rotating and the drive means includes a flexible cable drive for the shaft.

In a specific embodiment which has produced excellent results, the openings in the central shaft are equally spaced around the circumference of the shaft, although randomly distributed along the length of the shaft and a sliding electrical contact is attached to the shaft for connecting the shaft to a positive voltage supply. Further, particularly when used for the specific purpose outlined above, the cathode cylinder is oriented vertically and is fabricated from a sheet of austenitic stainless steel. In addition, the central shaft is mounted on upper and lower "Teflon" (p.t.f.e.) bearings.

In accordance with a further important feature of the invention, the anode basket includes a plurality of wiper blades mounted on the outer surface thereof for removing dendrites ("trees") which form between the cylinder and basket so as to prevent short circuiting between the basket and cylinder such as may be caused by this growth of dendrites therebetween. In addition, a further basket is provided at the bottom of the cell for catching dendrites removed by the wiper blades. In the specific embodiment referred to, the wiper blades comprise epoxy coated wooden blades and the further basket comprises a cylindrical basket of fine mesh austenitic stainless steel.

Other features and advantages of the present invention are set forth in, or apparent from, the detailed description of a preferred embodiment of the invention found hereinbelow.

DESCRIPTION OF A PREFERRED EMBODIMENT

Figure 2:
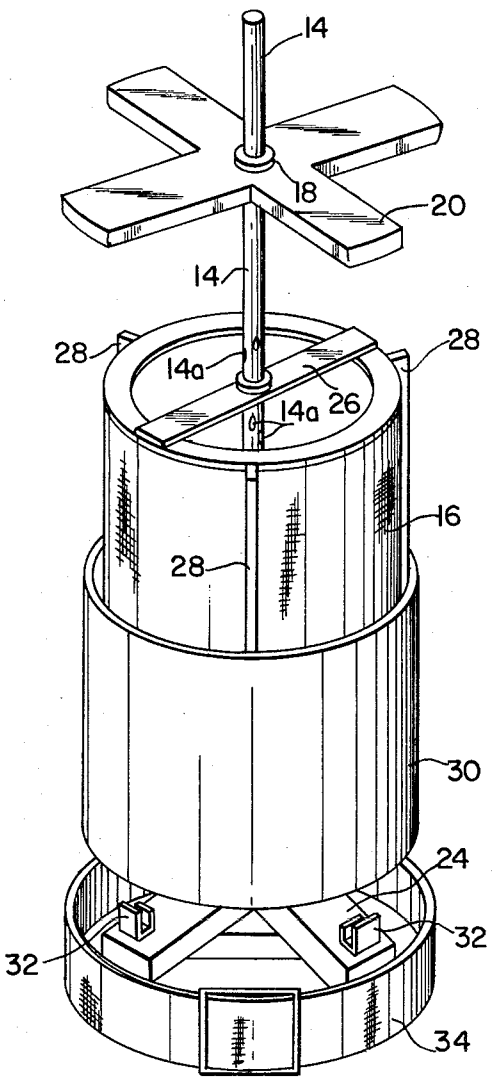
FIG. 2 is an exploded perspective, to a reduced scale, of the cell of FIG. 1, with the outer housing removed.
Figure 1:
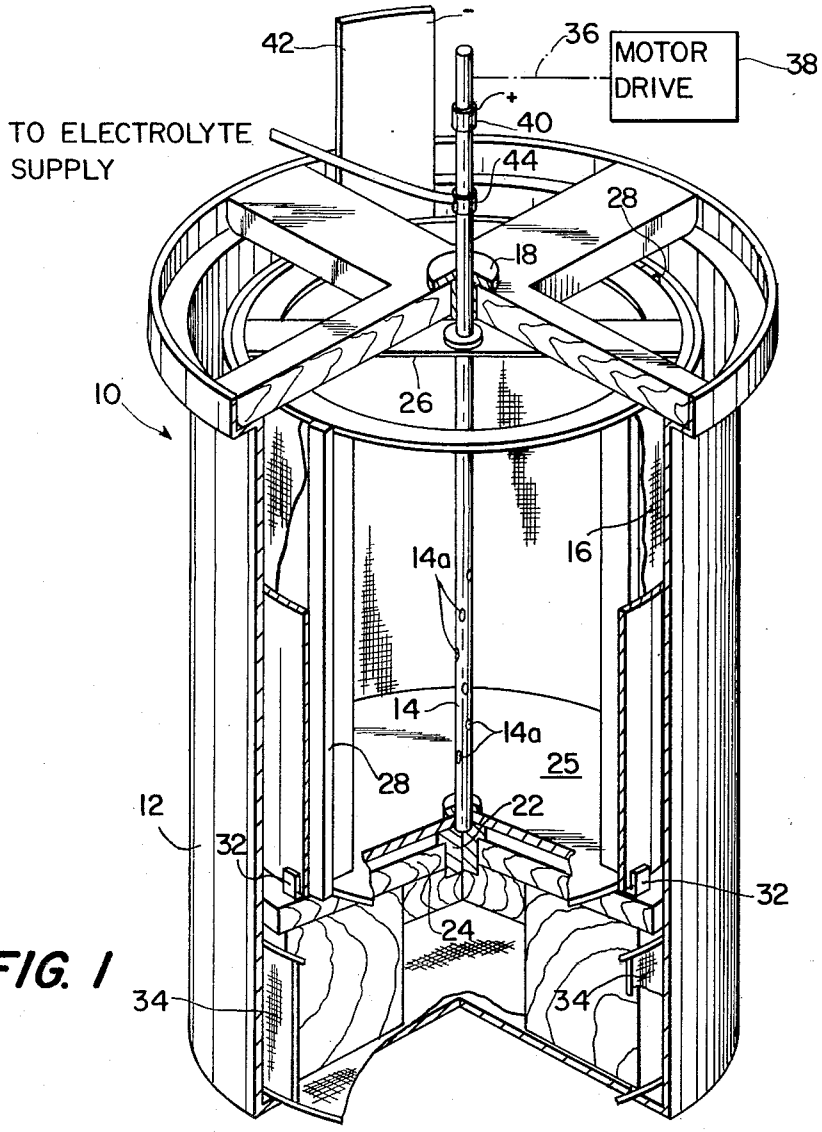
FIG. 1 is a partially broken away perspective view of an electrolytic stripping cell constructed in accordance with the invention.

Referring to FIGS. 1 and 2, a preferred embodiment of the electrolytic stripping cell of the invention is illustrated. The cell, which is generally denoted 10, comprises an outer cylindrical tank 12, which houses the components of the cell as well as the cell electrolyte and which is fabricated of polyethylene in an exemplary embodiment. A central shaft 14, which provides rotation of a cylindrical anode basket 16, is itself mounted for rotation on an upper bearing 18 which is supported by an upper cross-shaped support member 20 and a lower bearing 22 which is supported on a lower base support member 24. In the exemplary embodiment under consideration, shaft 14 is fabricated of type 304 stainless steel, bearings 18 and 22 are made of p.t.f.e. and support members 20 and 24 are fabricated of wood with an epoxy coating. In accordance with an important feature of the invention, the shaft 14 comprises a tubular member or tube through which an electrolyte is circulated and which includes a plurality of openings 14*a* therein through which the electrolyte exits, as is explained in more detail below.

As illustrated, the rotating anode basket 16, which has a solid bottom 25, is open at the top thereof and includes a diametrically extending support member 26 which serves to center shaft 14 and which includes an aperture at the midpoint thereof through which shaft 14 extends. Three vertically extending wiper blades 28, best seen in FIG. 2, are secured to the sides of anodes basket 16 at equally spaced locations. Blades 28 are preferably fabricated of epoxy coated wood while the perforate portions of anode basket 16 are preferably fabricated of fine mesh austenitic stainless steel.

A cylindrical metallic cathode 30, preferably made of rolled austenitic stainless steel, is located between housing 12 and anode basket 16 and surrounds the latter, being spaced therefrom by blades 28. Cathode 30 is mounted on support 24 and held in place thereon by upstanding clips or positioner members 32 affixed to support 24.

A collecting basket 34, preferably fabricated of fine mesh stainless steel, is positioned beneath anode basket 16 and cylindrical cathode 30, with the cylindrical side walls of collecting basket 34 surrounding wooden support 24. Rotation anode basket 16 is controlled by a flexible cable 36 and associated motor drive 38 comprising a conventional gear box and motor. Cable 36 is attached at one end to shaft 14 and at the other to motor drive 38. In an exemplary embodiment, this arrangement provides rotating speed of ½ to 10 revolutions per minute. Rotation of the anode basket 16 provides appropriate stirring of the cell electrolyte and increases the recovery as compared with "stagnant" electrolyte systems. During this rotation vanes 28 serve to knock off the silver "trees" which tend to grow between the cathode cylinder 30 and anode basket 16 and which can cause short circuiting of the cell electrodes.

A sliding-type rotating electrical contact 40 is located near the top of center shaft 14 of anode basket 16. A negative terminal plate 42 (not shown in FIG. 2) is affixed to cylindrical cathode 30.

As stated above, the provision of perforate shaft 14 is an important feature of the invention. In a specific embodiment, a medium walled, 304 stainless steel tube having thirty-six 3/32 inch diameter drilled holes equally spaced, and randomly disposed around the circumference thereof was used to replace a solid shaft. In order to provide an inlet to tubular shaft 14, a rotary gland or seal indicated schematically at 44, is positioned above upper p.t.f.e. bearing 18 and below sliding electrical contact 40 so as to permit the electrolyte to be pumped down hollow shaft 14 and out through holes 14*a* into the shredded silver-brazed, stainless steel honeycomb scrap in the anode basket. Although utilization of a solid shaft in combination with a rotating anode basket provides a substantial increase in silver recovery over a "stagnant", i.e., non-circulating system, this resultant recovery was only about 75%. However, the additionally increased electrolyte circulation provided by perforate shaft 14, together with experimentally determined optimization techniques, has resulted in silver recoveries of greater than 97%.

Although the invention has been described in relation to exemplary embodiments thereof, it will be understood by those skilled in the art that variations and modifications can be effected in these exemplary embodiments without departing from the scope and spirit of the invention.

We claim:

1. An electrolytic stripping cell for recovering silver and other metals from bulky, low density scrap containing such metals, said cell comprising: a rotatable perforated basket for receiving charge of said scrap and constituting one electrode of said cell; a metallic cylinder surrounding said basket and spaced therefrom, said cylinder constituting the other electrode; a housing in which said basket and said cylinder are contained; means for supplying an electrolyte to said cell; and means for rotating said basket to provide agitation of the electrolyte within the cell, said means for supplying an electrolyte to said cell including a hollow shaft disposed centrally of the cell and having a plurality of openings along the length thereof through which said electrolyte passes.

2. An electrolytic stripping cell as claimed in claim 1 wherein said hollow shaft is affixed to said rotatable basket and said means for rotating said basket comprises drive means for rotating said shaft.

3. An electrolytic stripping cell as claimed in claim 2 wherein said electroyte supplying means further comprises a rotating seal mounted on said shaft for permitting electrolyte to be supplied to said shaft while said shaft is rotating.

4. An electrolytic stripping cell as claimed in claim 2 wherein said drive means includes a flexible cable drive for said shaft.

5. An electrolytic stripping cell as claim in claim 2 wherein said openings are equally spaced around the circumference of said shaft.

6. An electrolytic stripping cell as claimed in claim 2 further comprising a sliding electrical contact attached to said shaft for connecting said shaft to a positive supply.

7. An electrolytic stripping cell as claimed in claim 1 wherein said cylinder is oriented vertically and is fabricated of rolled austenitic stainless steel and wherein said rotatable basket is oriented vertically and is fabricated of fine mesh austenitic stainless steel.

8. An electrolytic stripping cell as claimed in claim 1 wherein said basket includes a central shaft, and upper and lower p.t.f.e. bearings are provided for mounting said shaft for rotation within said housing.

9. An electrolytic stripping cell as claimed in claim 1 wherein said basket fills substantially the entire volume of said housing.

10. An electrolytic stripping cell as claimed in claim 1 wherein said anode basket includes a plurality of wiper blades on outer surface thereof for removing dendrites which form between the cylinder and basket so as to prevent short circuiting between the basket and cylinder such as may be caused by the growth of said dendrites therebetween.

11. An electrolytic stripping cell as claimed in claim 10 further comprises a further basket for catching dendrites removed by said wiper blades.

12. An electrolytic stripping cell as claimed in claim 7 comprises a plurality of epoxy coated wooden wiper blades attached to the outer wall of said basket and said cylinder, said cell further comprising a further cylindrical basket fabricated of fine austenitic stainless steel located at the bottom of said cell.

* * * * *